United States Patent [19]

Hoyt

[11] Patent Number: 4,840,332

[45] Date of Patent: Jun. 20, 1989

[54] GOLF BALL HOLDER

[76] Inventor: David D. Hoyt, 4170 Motor Ave., Culver City, Calif. 90230

[21] Appl. No.: 89,537

[22] Filed: Aug. 26, 1987

[51] Int. Cl.[4] ..... B60R 9/00

[52] U.S. Cl. ..... 224/274; 224/919; 224/251; 224/247

[58] Field of Search ..... 224/224, 242, 249, 251, 224/274, 919, 245, 247; 206/315, 9; 221/185; 273/32 D

[56] References Cited

U.S. PATENT DOCUMENTS

| | | | |
|---|---|---|---|
| 1,911,256 | 5/1933 | Andrew | 224/919 X |
| 2,570,504 | 10/1951 | Van House | 224/919 X |
| 3,206,067 | 9/1965 | Smith, Jr. et al. | 221/185 X |
| 4,106,678 | 8/1978 | Thomas | 206/315.9 X |
| 4,151,936 | 5/1979 | Hawkes | 224/224 |
| 4,678,108 | 7/1987 | Inman | 224/274 |

*Primary Examiner*—Henry J. Recla
*Assistant Examiner*—Linda J. Sholl
*Attorney, Agent, or Firm*—Whann & Connors

[57] ABSTRACT

Disclosed is a golf ball holder comprising a generally cylindrical wall element forming a tubular member. There is an elongated aperture running along the entire length of the tubular member between opposed open ends in the tubular member. The tubular member is of a uniform diameter with the opposed open ends having a diameter slightly less than the diameter of the golf balls. The tubular member is made of a resilient material to enable the wall element to expand outwardly when a golf ball is inserted into either of the open ends. The aperture is sufficiently wide to allow the finger of the user to be inserted into it to force a golf ball out of either end but not so wide as to allow a golf ball to be inserted into the tubular member through the aperture. There is a stop member at one of the open ends which prevents a ball from passing through this end unless the user applies pressure to the golf ball and forces it past the stop member. At the end opposite this stop member is a connector which allows the holder to be removably attached to, for example, a caddy cart, golf bag, or belt loop so that the holder can be oriented in a vertical position.

3 Claims, 1 Drawing Sheet

GOLF BALL HOLDER

BACKGROUND OF THE INVENTION

1. Field of the Invention:

This invention relates to a golf ball holder, particularly a golf ball holder for holding three golf balls in a row that can be conveniently carried in a generally vertical orientation and allows the golfer to insert or withdraw golf balls from either end of the holder.

2. Background Discussion:

There is a substantial demand for golf accessories and in particular devices for holding golf balls which allow the golfer to conveniently carry several golf balls with him during play. Typically, golf balls are sold in groups of three with the three golf balls being aligned in a row in the golf package. There are generally cylindrical tubular members employed to do this which have a slit running along the length of the tube that allows the golf balls to be inserted through this slit into the tubular member. These tubular members are generally mounted in a horizontal position on a caddy cart, or similar device, but are not ordinarily carried by the golfer. It is the objective of this invention to provide a golf ball holder which can be conveniently carried by the golfer, for example, attached to a caddy cart, a golf bag, or the belt loop of the golfer, and disposed in a generally vertical position without the golf balls being jarred loose from the holder during play.

SUMMARY OF THE INVENTION

The present invention is a golf ball holder designed to hold three golf balls aligned in a row which may be conveniently carried by a golfer in a vertical orientation without the golf balls being jarred loose yet permitting the golfer to easily withdraw or insert golf balls from either end of the holder. It is easy to manufacture and convenient to use.

There are several features of this invention which contribute to its desirable attributes. Without limiting the scope of this invention as expressed by the claims, its more prominent features will now be discussed briefly. After considering this discussion, particularly after reading the section of this application entitled DETAILED DESCRIPTION OF THE PREFERRED EMBODIMENT, one will understand how the features of this invention provide a golf ball holder which is convenient for the golfer to use and is inexpensive to manufacture.

One feature of this invention is the use of a generally cylindrical wall element formed into a tubular member having an aperture which runs along the entire length of the tubular member between opposed open ends in said member. The wall element is made of a resilient material such as plastic, which allows the wall element to expand outwardly when a golf ball is inserted into either end of the tubular member. Upon insertion of the golf ball into an open end, the wall element expands outwardly and then, because of its resilient characteristic, firmly grips the golf ball.

Another feature of this invention is that the aperture is sized so that a golf ball cannot be inserted into the tubular member through the aperture but only into the tubular member at either of the opposed open ends. The aperture, however, is sufficiently wide to allow the golfer to insert his finger into the aperture for ease of removal of a golf ball from the tubular member.

Another feature of this invention is the use of a stop member at at least one end of the tubular member to prevent a ball from accidentally jarring loose during use. This stop member projects from the wall element into the interior of the tubular member, abutting a golf ball inserted into the holder. The stop member is designed to hold the golf ball in position during the ordinary course of play, but when the user applies pressure to the golf ball, the golf ball will ride over the stop member, forcing the wall element to expand outwardly as the golf ball is forced by the golfer through the open end. Thus, the holder can be oriented in a generally vertical position without the golf balls inadvertently jarring loose from the holder.

The fourth feature of this invention is the use of a connector adjacent the end of the tubular member opposite the end at which the stop member is placed. This connector is designed to allow the holder to be removably attached to, for example, a caddy cart, a golf bag, or the golfer's belt loop. Preferably, the connector is designed so that it will also provide a stop member that prevents the accidental jarring loose of a golf ball during the ordinary course of play.

BRIEF DESCRIPTION OF THE DRAWING

The preferred embodiment of this invention illustrating all of its features will now be discussed in detail with reference to the attached drawing, wherein like numerals indicate like parts, and in which.

DESCRIPTION OF THE PREFERRED EMBODIMENT

Figure 1:
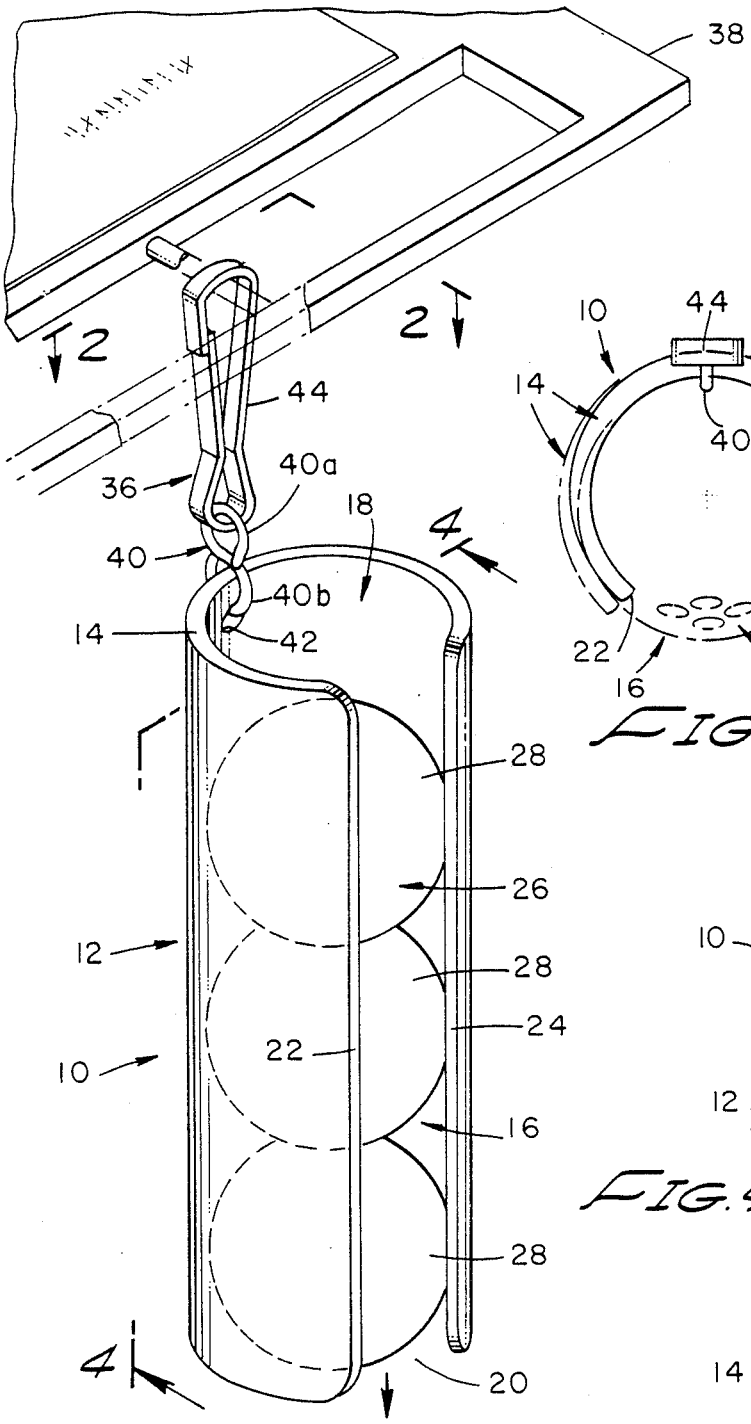
FIG. 1 is a perspective view of the golf ball holder of this invention removably attached to a caddy cart and holding three golf balls lined in a row.

As illustrated in the drawing, the golf ball holder 10 of this invention comprises a tubular member 12 formed by a wall element 14 having a generally C-shaped cross section. Because of the cross-sectional configuration of the wall element 14 there is provided an aperture 16 in the holder 10 running along the entire length of the tubular member 14 between opposed open ends 18 and 20 in the tubular member. This aperture 16 is formed by the parallel edges 22 and 24 of the wall element which are spaced apart to provide a gap 26 that allows the golfer to insert his or her finger into the aperture 16 for removal of golf balls. the aperture may be on a bias, but is preferably parallel to the longitudinal axis of the tubular member 14 as shown.

Figure 2:
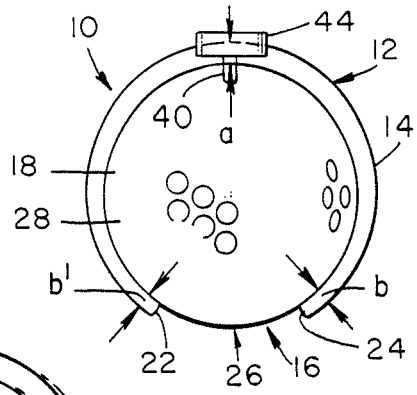
FIG. 2 is an end view taken along line 2—2 of FIG. 1.

The tubular member 12 has a uniform diameter, thus providing opens ends 18 and 20 which have diameters that are equal. The diameter of these open ends 18 and 20 is less than the diameter of a conventional golf ball 28 but is sufficiently great to allow the golf ball to be inserted into either end 18 or 20, forcing the wall element 14 to expand outwardly, widening the distance between the opposed edges 22 and 24 as the ball is inserted into the tubular member. As illustrated best in FIGS. 2 and 3, with the golf ball 28 inserted into the holder 10, the wall element 14 expands outwardly, with the edges 22 and 24 being spaced apart a specific distance away from each other. Upon removal of all the golf balls 28 from the holder 10, the wall element 14 contracts inwardly, with the edges 22 and 24 being drawn towards each other so that they are now closer to each other than when a golf ball is in the holder. The spacing between these edges 22 and 24 is sufficiently close, however, so that a golf ball 28 cannot be inserted into the tubular member through the aperture 16. In accordance with this invention, a golf ball 28 may only be inserted into the holder through either end 18 or end 20 of the tubular member 20.

Figure 3:
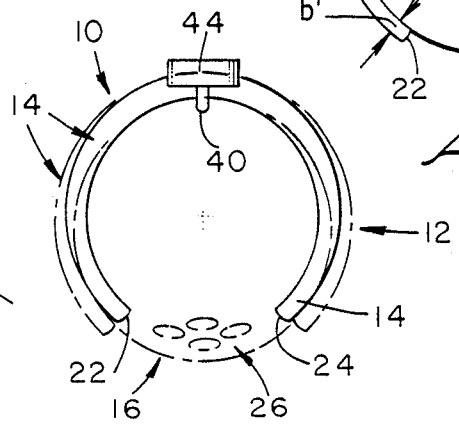
FIG. 3 is a cross-sectional view similar to that shown in FIG. 2 except that all of the golf balls have been removed from the golf ball holder of this invention allowing the cylindrical wall element to contract inwardly.
Figure 4:
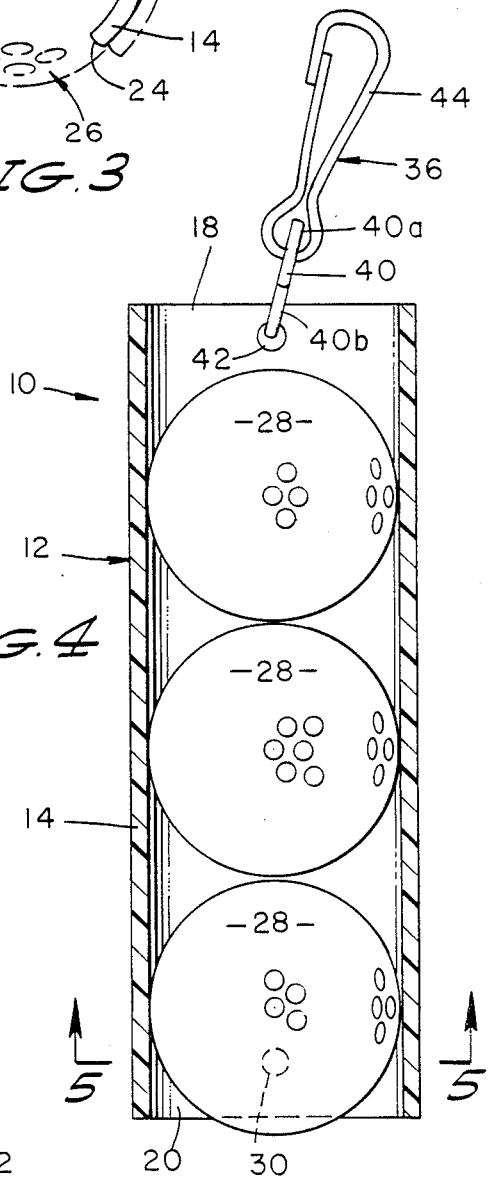
FIG. 4 is a cross-sectional view taken along line 4—4 of FIG. 1.

As best shown in FIG. 3, the thickness of the wall element is preferably greater at the central section a of the wall element 14 and thinner at the edges b and b′ tapering down to this thinner width from the central section. Because of the C-shaped cross section of the wall element 14, it will act like a clamp, expanding outwardly as golf balls are inserted through either end 18 or end 20 and contracting inwardly when all the balls are removed from the holder 10. To insure that the balls will not be accidentally jarred loose from the holder 10 during the normal course of play, a stop element 30 is located adjacent the one end 20. As illustrated in FIG. 1, this end 20 is the lowermost end when the holder 10 is oriented in a vertical position.

Figure 5:
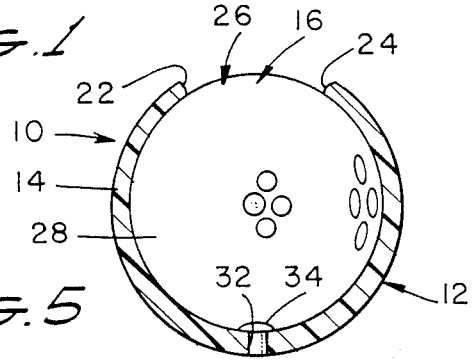
FIG. 5 is a cross-sectional view taken along line 5—5 of FIG. 4.

As shown in FIG. 5, the stop element 30 is simply a rivet which is inserted through a hole 32 in the wall element 14 adjacent the one end 20. This stop element 30 includes a rounded head 34 projecting from the wall element 14 into the interior of the tubular member 12. The rounded head 34 facilitates the ball 28 moving past the stop element 30 and out the open end 20 when the golfer intentionally inserts his or her finger into the aperture 16 and applies pressure to a golf ball 28 pushing it past the stop element. The stop element, however, applies sufficient resistant force to the golf ball 28 adjacent it to prevent this ball from jarring loose during the normal course of play.

At the end 18 there is provided a connector 36 which enables the holder 10 to be removably attached to, for example, a caddy cart 38. This connector 36 consists of an 'S' ring 40 inserted into a hole 42 adjacent the end 18 and a clip 44 attached to the external loop **40*a* of the 'S' ring 40. The internal loop 40*b* of the 'S' ring 40 acts as a stop which, if the caddy cart falls over and inverts the holder 10, would prevent the balls 28 from being jarred loose from the holder through this end 18**.

The wall element 14 may be made from any suitable resilient material, but preferably is made from ABS resin sold by BORG WARNER Corporation under the product identification CYCOLAC. This resin material is particularly useful for forming the tubular member through an extrusion process, although the tubular member may also be injection molded. Typically, the wall element 14 will have dimensions in accordance with the following specifications: (1) a length ranging between 4.25 and 5.75 inches, (2) an inside diameter (prior to inserting ball) ranging between 1.500 and 1.750 inch, (3) distance between edges 22 and 24 ranging between 0.500 and 1.000 inch, and (4) wall thickness ranging between 0.095 and 0.130 inch.

SCOPE OF THE INVENTION

The above description presents the best mode contemplated of carrying out the present invention as depicted by the preferred embodiment disclosed. The combination of features illustrated by this embodiment provides its convenience of use and ease of manufacture. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions found within the scope of the invention as generally expressed by the following claims.

I claim:

1. A device adapted to be oriented in a vertical position for holding three golf balls aligned in a row, comprising a wall element made of a resilient plastic material, said wall element having edges and being formed into a tubular member with the cross section of the wall being partially circular in configuration with said edges being opposed and parallel with each other and spaced apart a distance ranging between 0.500 and 1.000 inch to define an aperture, said distance being sufficient to allow a user to insert a finger into the aperture but sufficiently restrictive to prevent a golf ball from being inserted into the tubular member through said aperture, and the resiliency of the wall element being sufficient to grip a golf ball placed within the tubular member from an end thereof but insufficient to allow the wall element to expand so that the distance between said edges exceeds 1.000 inches.

said tubular member having opposed open ends having an inside diameter prior to inserting a golf ball ranging between 1.500 and 1.750 inch, said diameter being less than the diameter of the golf balls yet sufficiently great to allow a golf ball to be inserted into an open end, with the wall element expanding outwardly as the golf ball enters the tubular member, said wall element gripping the ball firmly upon insertion into the tubular member, and a stop member adjacent one of said open ends and projecting from the wall element into the interior of the tubular member a sufficient distance to prevent a golf ball from moving through said open end unless the user intentionally applies pressure to the golf ball to force it past the stop member.

2. The device of claim 1 wherein there is a connector attached to the tubular member adjacent the open end opposite the open end at which the stop member is located.

3. The device of claim 2 wherein there is a second stop member at said open end where the connector is attached.

* * * * *